United States Patent [19]

Mita

[11] Patent Number: 4,559,542

[45] Date of Patent: Dec. 17, 1985

[54] THERMAL PRINTING HEAD

[75] Inventor: Tsunemasa Mita, Ebina, Japan

[73] Assignee: Fuji Xerox Co., Ltd., Tokyo, Japan

[21] Appl. No.: 500,338

[22] Filed: Jun. 2, 1983

[30] Foreign Application Priority Data

Jun. 7, 1982 [JP] Japan ..... 57-97171

[51] Int. Cl.[4] ..... H05B 3/00

[52] U.S. Cl. ..... 346/76 PH; 219/543; 219/216

[58] Field of Search ..... 346/151, 139 C, 76 PH, 346/76 R; 219/216 PH, 539; 400/120; 358/296, 298; 250/318, 317.1

[56] References Cited

U.S. PATENT DOCUMENTS 4,250,375 2/1981 Tsatsumi et al. ..... 219/543

4,401,993 8/1983 Moriguchi et al. ..... 346/76 PH

FOREIGN PATENT DOCUMENTS 0193376 11/1982 Japan ..... 400/120

*Primary Examiner*—E. A. Goldberg

*Assistant Examiner*—A. Evans

*Attorney, Agent, or Firm*—Handal & Morofsky

[57] ABSTRACT

A thermal printing head for multi-tone reproduction includes a plurality of heating resistors disposed along the scanning line which differ in the magnitude of thermal output upon energization thereof by the same electric current for an identical time period. This effect is achieved by differing the heating area or by differing resistivity of each heating resistors. Selective energization of none, one or more of the heating surfaces enables the reproduction of different tones or colors on the thermo sensitive paper.

6 Claims, 5 Drawing Figures

THERMAL PRINTING HEAD

BACKGROUND OF THE INVENTION

The present invention relates generally to a thermal printing device for use in facsimiles or similar image reproduction equipment, and particularly to a thermal printing head for printing multiple color or graduated tone images on paper coated with thermo sensitive chemical.

In the commonly available thermal printing devices, a thermal printing head is provided with multiple rows of heating spots over its surface extending in the direction of the scanning lines as indicated by arrow Q in FIG. 1. Each of these rows divided from a single bar of heating resistor 1 is substantially uniform in thickness and width along the length. As shown in FIG. 1 which illustrates a heating resistor of the thermal printing head of a conventional thermal printing device, equal numbers of electrodes "a" and "b" (each suffixed with a sequential number in the drawing, for example, a-1, a-2, a-3 and so on) are laid laterally in an alternative manner on the heating resistor 1. From the electrodes "a" and "b", electric power is selectively supplied. By each pair of the adjacent electrodes "a", "b", the heating resistor 1 is divided into heating surfaces or heating spots, "h" (represented in the drawing as h-1, h-2, h-3 and so on) which produces heat energy when the associated electrode pair are energized. By appropriately selecting the electrode pairs to be energized, a desired pattern of the heating surfaces to heat up the thermo sensitive paper is formed. As a result, the thermo sensitive chemical on the paper will be thermally stimulated to develop an image exactly outlined by the pattern. These prior art devices have been very effective only where monochrome reproduction is required.

Currently, however, progressively increasing emphasis has been placed on the need for multiple color tone graduation reproduction. For multiple color or tone development, different types of thermo sensitive paper are used which produce varying colors when exposed to different levels of temperature. If any of these conventional devices is to be employed for this purpose, it has to be equipped with an extremely complicated control circuit capable of varying the current in voltage or time span of conduction to each programmed heating surface.

SUMMARY OF THE INVENTION

This invention is directed to the technique of image printing applicable to multiple color as well as tone graduation reproduction, in which the disadvantages inherent in the prior art devices are eliminated. It is therefore a general object of the present invention to provide a thermal printing head of an image reproduction device which can provide multiple color or tone graduation processing on thermo sensitive paper.

Another object of the present invention is to provide such a thermal printing head of simple construction, with no need of incorporating a complicate control circuit to achieve the object.

In accordance with this invention, the thermal printing head is provided with a pattern of heating spots in plural axial rows extending along the scanning lines. Each heating spot comprises a group of heating surfaces of heating resistors differing in area or resistance from one another. The heating surfaces are individually connected to a power source for independent energization, and produce heat of different temperatures upon energization. Accordingly, selective energization of either one or both of the heating surfaces of a heating spot causes the spot to heat with a predetermined different temperature. In operation, scanning with the individual heating spots to produce a pattern of spots of locally different temperature provides on the multi-color thermo sensitive paper an image in points colored depending on the temperatures of the heating spots. It will be appreciated that, since variations in the areas or resistance values of the spots are utilized for an image to be colored in varying hues or tones, there is no need for a complicated circuit control which controls the output voltage or time span of conduction of the circuit.

These and other objects and advantages of the present invention will be apparent from the following description of the preferred embodiment with reference to the accompanying drawings.

DETAILED DESCRIPTION OF THE INVENTION

Figure 1:
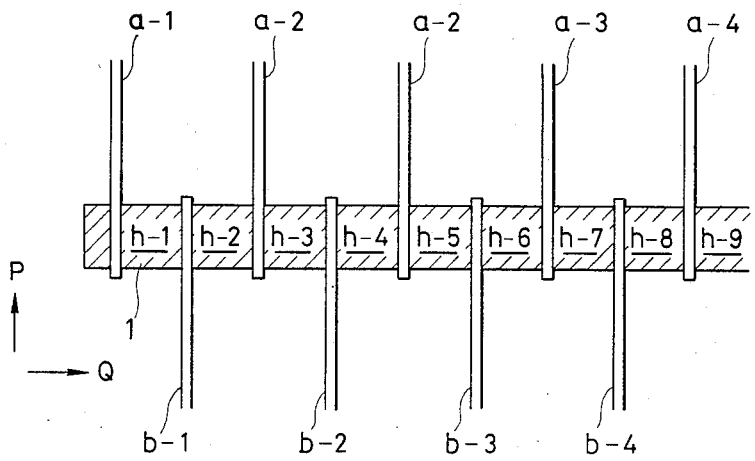
FIG. 1 is a schematic view of a conventional thermal printing head for use in a image reproduction device.
Figure 2:
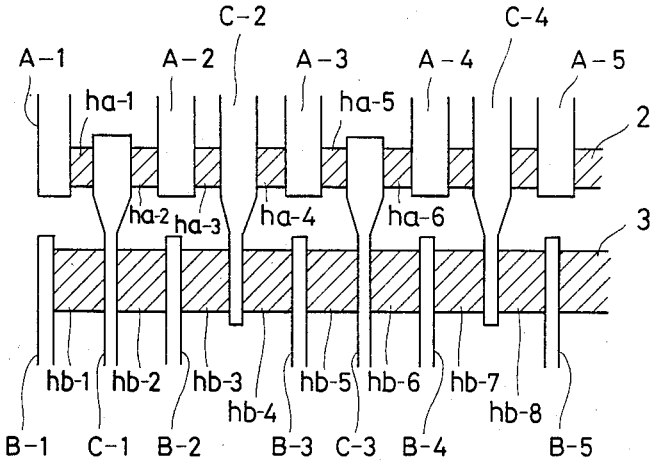
FIG. 2 is a schematic view of a thermal printing head according to the present invention.

Referring first to FIG. 2, in which the thermal printing head comprises a pair of strips of heating resistors 2, 3, each preferably uniform in length and width within the same strip, extending parallel with the scanning line and differing in width from each other, both being closely positioned. Across the heating resistor 2 are placed a plurality of equally spaced electrodes "A" (represented in the drawing as A-1, A-2, A-3, and so on) for supplying electricity therethrough. The heating resistor 3 is a also transversed by a plurality of electrodes "B" (likewise represented as B-1, B-2, B-3 and so on). There are the same number of the electrodes "A" as that of the electrodes "B", each of which may be situated opposite one of electrodes "A". A third group of electrodes "C" (C-1, C-2, C-3 and so on) are coupled to both of the heating resistors 2 and 3 across their width. Each of electrodes "C" divides a resistor surface between the adjacent electrodes "A" and "B" to define a pair of heating surfaces "ha" (suffixed with a numerical number in the drawing, for example, ha-1, ha-2, ha-3 and so on) on the heating resistor 2 and form similarly a pair of heating surfaces "hb" (hb-1, hb-2, hb-3 and so on) on the heating resistor 3. In this embodiment, the heating surface "hb" is made larger in area compared with the heating surface "ha".

With this arrangement, energization of a given heating surface "ha", "hb" for heat generation requires connection of an associated electrode "C" to its adjacent electrode "A" or "B", through the power source. To illustrate, if heating surface ha-1 or hb-1 is to be heated, electrode C-1 is required to be connected to electrode A-1 or B-1 across the power source. This operation may be represented in a relationship chart as shown in the following table, in which the binary words "ones" and "zeros" represent the condition of electrodes "A", "B" and "C", and heating surfaces "ha" and "hb". In this case, a "one" indicates that an electrode is being supplied with electricity and that a heating surface is producing heat, whereas a "zero" represents that the electrode is not being supplied with electricity and the heating surface is not producing heat.

| Electrode | | | Heating surface | |
|---|---|---|---|---|
| A | B | C | ha | hb |
| 0 | 0 | 0 | 0 | 0 |
| 1 | 0 | 1 | 1 | 0 |
| 0 | 1 | 1 | 0 | 1 |
| 1 | 1 | 1 | 1 | 1 |

Figure 3:
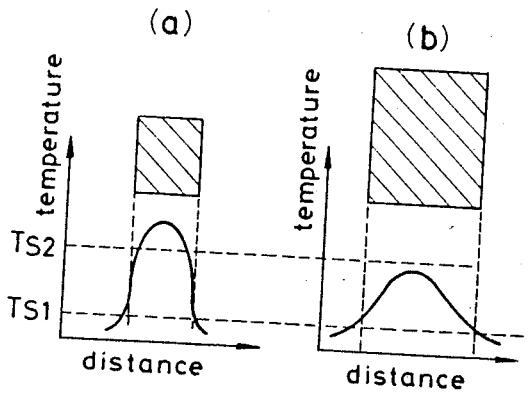
FIG. 3 is a graphical representation illustrating the heat generation by the heating surfaces of different areas.

Since there are differences in the areas of heating surfaces "ha" and "hb" as previously stated, the heat produced by them causes different temperatures. FIG. 3 illustrates this relation, in which temperature is taken along the vertical axis with two levels TS1 and TS2 indicative of temperature levels which produce the first and second tone or color on the thermo sensitive paper (hereafter called a first and a second tone development level). FIGS. 3(*a*) and 3(*b*) are respectively the curves of temperature distribution produced by heating surface "ha" and "hb" when they are energized. The areas of heating surfaces "ha" and "hb" are selected, so that the heating surface "ha" has its peak temperature above the second tone development level TS2, whereas the heating surface "hb" has its maximum temperature somewhere between the first and second tone development levels TS1 and TS2. Thus, energization of the heating surface "hb" produces heat whose temperature is at or above the level TS1 over a relatively larger area, related to the area of heating surface "hb", thus developing the first tone on the thermo sensitive paper. On the other hand, heating surface "ha" produces heat whose temperature is at or above the level TS2 to develop the second tone on the paper over a relatively smaller area, related to that of heating surface "ha". Smaller area of the heating surface produces a higher temperature when energized because it has greater resistance due to the high density of electric current.

Figure 4:
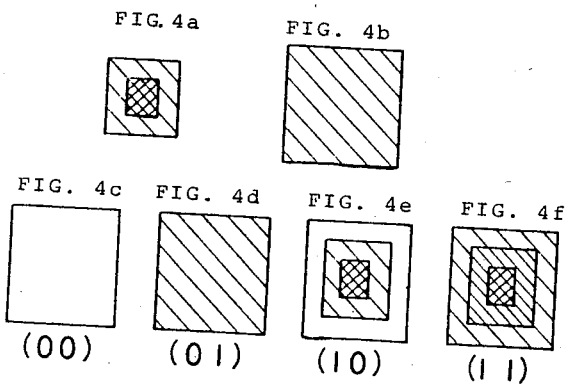
FIG. 4 shows the different tone graduation or colors on the heat sensitive paper produced by different combinations of heating areas.
Figure 5:
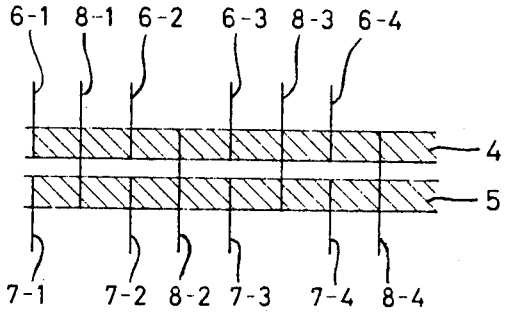
FIG. 5 is a schematic view of another embodiment of the thermal printing head according to the present convention.

Consider now a scanning spot comprising a pair of adjacent heating surfaces of different areas, for example, ha-1, hb-1. Energization of none, one or both of heating surfaces ha-1, hb-2 causes the scanning spot to affect the corresponding unit area on the thermo sensitive paper in one of the following tone conditions; unaffected, surface ha-1 peak temperature affected, surface hb-1 peak temperature affected, both surfaces ha-1 and hb-1 peak temperature affected tones. In this way, four temperature-dependent tones are possible on the thermo sensitive paper. The two tone patches defined by surfaces "ha", "hb" of a scanning point on the paper may appear as a single tone to the eye. FIGS. 4(*c*) through 4(*f*) are the tones developed by different combinations of the heating surfaces "ha" and "hb" of a scanning point. The numerical code comprising two figures ("one" and "zero") given below each tone block denotes the electricity supplying condition at a scanning point that produces tone and may be referred to the foregoing table. To illustrate, FIG. 4(*c*) is the case, or the tone of the thermo sensitive paper itself, where neither of the heating surfaces "ha", "hb" of the scanning point has been energized. Energization of either of heating surfaces "ha", "hb" develops the tone of FIGS. 4(*d*) or 4(*e*). When both of heating surfaces "ha" and "hb" are simultaneously connected to the power source, the tone of FIG. 4(*f*) will be induced. FIG. 5 is a schematic view showing the second embodiment of the thermal printing head according to the present invention. Similar to the first embodiment, there are provided a pair of strips of heating resistors 4 and 5 of uniform width and thickness placed substantially parallel with the scanning line. The heating resistors 4 and 5 are identical in width but made of different materials having a different resistivity. Across the heating resistor 4 are placed a plurality of equally spaced electrodes 6 (represented in the drawing as 6-1, 6-2, 6-3 and so on) for supplying electricity therethrough. The heating resistor 5 is likewise transversed by a plurality of electrodes 7 (shown as 7-1, 7-2, 7-3 and so on), individually connected to the resistor 5. Each of the electrodes 7 may be situated opposite one of electrodes 6. A third group of electrodes 8 (shown as 8-1, 8-2, 8-3 and so on) are connected to both of the heating resistors 4 and 5 for supplying current therethrough. Each electrode 8 divides the portion between adjacent electrodes 6 on the heating resistor 4 to define a pair of equal areas on both sides and between adjacent electrodes 7 on the heating resistor 5 to form a pair of equal areas on both sides. Unlike the first preferred embodiment, a subdivided area on the heating resistor 4 has the same area as that on the heating resistor 5. Each scanning spot comprises a pair of adjacent areas, the one on the heating resistor 4 and the other on the heating resistor 5. With this arrangement, operation is substantially similar to that of the first embodiment. The difference lies in that in this modified from the different tone inductive temperatures are dependent on the different resistivities, not on the varying heating areas. This particular modification is suitable where two-tone reproduction is required. The materials for the resistors 4, 5 can be any appropriate combination of known metals or alloys or dioxides.

It is to be noted that in the above embodiments, distance between two heating resistor should be a multiple of the distance of the sub-scanning. In either of the two embodiments, the number of the heating resistors is two. However, it will be appreciated that the number is given only by way of illustration and may be more than two. Furthermore, while the present invention is described with respect to the thick film alternate strip lead type of drum circuit, it is also applicable to the thin film dividedly disposed lead type circuit.

It will be apparent from the above detailed description that the thermal printing head of the present invention can provide multi-color development as well as tone graduation reproduction without the need for a complicated control circuit.

What is claimed is:

1. A thermal printing head for multi-tone or multi-color image reproduction comprising:

a plurality of heating resistors disposed closely to each other along a path parallel to the direction of scanning, each of said plurality of heating resistors having different heating characteristics and being divided into a plurality of heating elements; and electricity supplying means for selectively and individually supplying electricity to any combination of said heating elements of said heating resistors so as to provide any desired combination of heat states of said heating element.

2. A thermal printing head as set forth in claim 1 wherein said plurality of heating elements of different heating resistors have areas different from those of the other heating resistor.

3. A thermal printing head as set forth in claim 1 wherein said heating resistors have resistivity different from one another.

4. A thermal printing head as in claim 2 wherein said elements in each of the heating resistors are disposed in a line perpendicular to the direction of scanning and wherein said electricity supplying means comprises a first plurality of electrodes which contact one of said heating resistors, a second plurality of electrodes which contact the other of said heating resistors and a third plurality of electrodes which contact both of said heating resistors the contact between all of said electrodes and said heating resistors occurs between adjacent elements in each respective heating resistor.

5. A thermal printing head as in claim 4, wherein the contact between all of said electrodes and said heating resistors occurs between adjacent elements in each respective heating resistor.

6. A thermal printing head as in claim 4, wherein that portion of the electrodes contacting one of said heating resistors is of a first width and that portion of said electrodes contacting the other of said heating resistors is of a different width.

* * * * *